United States Patent [19]

Murphy

[11] Patent Number: 4,949,385

[45] Date of Patent: Aug. 14, 1990

[54] APPARATUS AND METHOD FOR MAKING PRECIPITATION AUDIBLE

[76] Inventor: Robert Murphy, 124 Schoolhouse Rd., R.D. #2, Harveys Lake, Pa. 18618

[21] Appl. No.: 173,809

[22] Filed: Mar. 28, 1988

[51] Int. Cl.[5] ..... G10D 5/00

[52] U.S. Cl. ..... 381/118; 84/402; 340/602; 446/166; 116/69

[58] Field of Search ..... 84/402, 1.14; 340/602; 446/166; 116/69; 381/118, 124

[56] References Cited

U.S. PATENT DOCUMENTS

| | | | |
|---|---|---|---|
| 1,207,950 | 12/1916 | Longino | 116/69 |
| 1,442,162 | 1/1923 | Libera | 116/69 |
| 3,022,603 | 2/1962 | Kawabata | 84/402 |
| 3,524,007 | 8/1970 | Ishikawa et al. | 84/1.14 |
| 3,684,814 | 8/1972 | Neustadt | 84/1.14 |
| 3,695,993 | 10/1972 | McFarland | 446/166 |
| 4,504,823 | 3/1985 | Berthel | 340/602 |
| 4,692,751 | 9/1987 | Upton et al. | 340/602 |

*Primary Examiner*—Forester W. Isen

*Attorney, Agent, or Firm*—O'Keefe & Wilkinson

[57] ABSTRACT

A series of substantially horizontally disposed and extended chimes are mounted upon a bracket and positioned to interrupt the fall of rain adjacent a building. The impact of rain or other precipitation upon the chimes gives forth a pleasing sound which is soothing and in many cases soporific for the individuals within the building. The chime means may be of various shapes and arrangements and a transmission apparatus may be provided to conduct the sound of the chimes into the building structure, although the sound of the rain will normally be conducted through an open window or the like into the interior during the sleeping or resting periods of individuals within the building.

20 Claims, 3 Drawing Sheets

FIG. 1
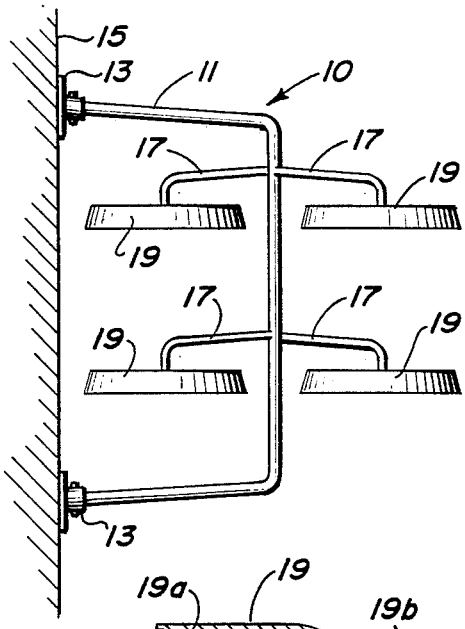
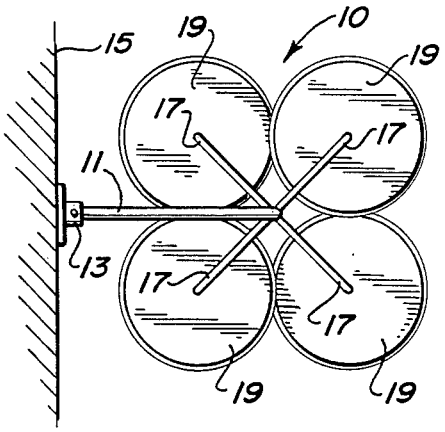
FIG. 2
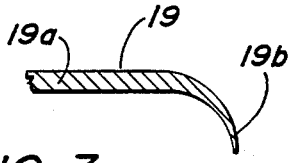
FIG. 3
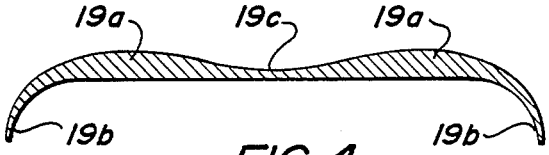
FIG. 4
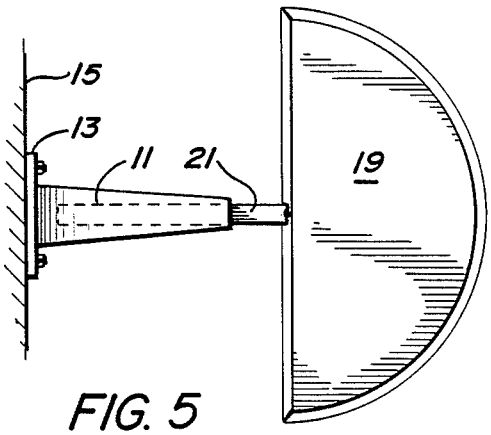
FIG. 5
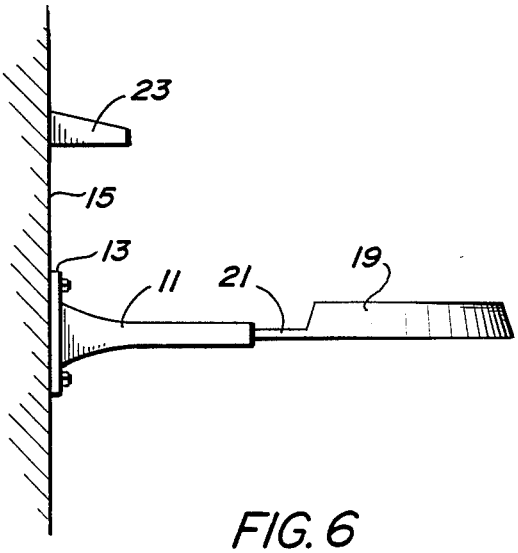
FIG. 6

APPARATUS AND METHOD FOR MAKING PRECIPITATION AUDIBLE

BACKGROUND OF THE INVENTION

1. Field of the Invention.

This invention relates to audibilization, or making audible, precipitation and more particularly to a percussion apparatus or instrument for making precipitation, and particularly precipitation in the form of rain, more than normally audible. More particularly still, the apparatus comprises generally chime means for impact by rain or other precipitation, which, upon striking the chime means, causes it to give off a pleasing sound.

2. Description of the Prior Art.

As is well known, many persons find the sound of rain drops, or, in some cases, the sound of snow or light hail, to be not only pleasing, but extremely restful. Rain, for example, is often made audible by falling upon slightly resilient or resonant surfaces such as roofs, shed tops, and particularly dry leaves and the like. Frozen precipitation of various forms may also resound, particularly upon striking dry leaves that have remained upon trees or may be strewn on the ground. Many persons who have become accustomed to such sounds find them quite sleep inducing, or soporific. Moreover, the regular rhythmical impact upon various surfaces of falling precipitation of various kinds is to an even larger group of persons, restful and relaxing and, in some cases, almost hypnotic. Whether such effect is due to suggestion induced by association with remembered days and nights when it rained and there was little else to do but relax, through childhood association with sleep in a portion of a house where the sound of raindrops was heard, or through some innate rhythmical or associated process dependent upon the physiological makeup of the human body, is not important. The well recognized fact is that the sound of rain has a peculiar attraction for many people and is relaxing both when drowsy and when wide awake.

Under modern conditions of housing and living many persons have little chance to hear the impact of raindrops and other precipitation and consequently lose the benefits thereof. This is largely because modern housing places less emphasis upon structure exposed to precipitation adjacent to sleeping quarters that upon being struck by rain will resonate in a fashion to provide a pleasing and relaxing sound or tone. For example, in high-rise apartments there are frequently no surfaces exposed to rain immediately outside the windows, much less surfaces which are fortuitously constructed to resonate upon impact with raindrops. Few persons, furthermore, sleep in modern times under the eaves of a house or in shed type attachments where the impact of precipitation is clearly heard. Young people after growing up under such conditions, may even lack familiarity and experience with the relaxing and almost hypnotic effects of the impact of precipitation such as rain and in some cases snow and hail upon resonating surfaces.

Various types of chime devices activated by natural phenomena have been developed in the past, for example, the traditional wind chime type device which was popular earlier in this century, see for example, U.S. Pat. No. 1,012,560 issued December 19, 1911 to H. B. Keller, as well as U.S. Pat. No. Des. 224,853 issued Sept. 26, 1972 to R. P. Meyer. Such wind type chime devices have enjoyed in recent years a remarkable resurgence taking many and varied forms in which, in one manner or another, the horizontal force of the wind is made to bias the chimes or chime actuating elements transversely against other elements to cause a resonation in the chime elements giving off a pleasing and, in some cases, restful sound.

There have been other types of devices designed to be moved by the wind, for example, U.S. Pat. No. 2,722,195 issued Nov. 1, 1955 to A. J. Rockefeller discloses a contrivance mounted upon a bracket screwed to a wall or post which holds a swinging device including vertical planes which are acted upon by the wind in an erratic manner to cause an erratic movement which may serve to frighten birds and the like from telephone poles and other less than inconvenient places upon which they may otherwise roost. Other scarecrow type devices designed for activation by horizontal action of the wind are also known. For example, U.S. Pat. No. 3,085,545 issued Apr. 16, 1963 to E. G. Ore and U.S. Pat. No. 4,131,079 issued Dec. 26, 1978 to J. F. Rousseau are also designed for scaring birds.

Fluid operated chime means have also been known as disclosed in U.S. Pat. No. 3,695,993 issued Oct. 3, 1972 to N. T. McFarland. The McFarland device provides a series of reservoirs, from which water drips into the hollow ends of pivoted striker elements, each of which, when sufficient water has collected within such element, pivots downwardly so its opposite end strikes the protruding end of a clapper suspended in a chime member. The clapper thus impacts upon the surrounding chimes causing an audible tone. Meanwhile the water drains from the end of the striker element and into a further reservoir in which it collects and then drips into a similar striker element on a lower level which in turn pivots and impacts upon the end of a protruding clapper within a further chime element.

U.S. Pat. No 2,968,688 issued Jan. 17, 1961 to K. R. Skinner discloses a type of rain sensor which includes an extended surface designed for impact by raindrops. An insulating material is provided around the extended surface to insulate it from adjacent electrically conductive material. Raindrops falling upon the extended surface run to the side on such surface and upon bridging the insulating material connect the extended surface to an adjacent electrically conductive material to close a circuit and cause an alarm to be activated. Essentially two metallic members, one in the form of a shallow cup and the other in the form of a convex or flat plate are separated by an insulator. Preferably the two metallic members are formed of dissimilar metals, generally within the electromotive series. While the device is designed to give an alarm or to operate a motor to close windows or the like when it detects rain, there is no audibilization of the rain impacts except insofar as an alarm might be sounded, hardly a pleasing and relaxful event.

Other devices have been designed for audibilization of natural phenomenon, for example, U.S. Pat. No. 4,557,175 issued December 10, 1985 to M. Schumann discloses a musical instrument that produces various tones, such as whistle type tones when impacted or impinged upon by radiant energy which serves to elevate the temperature of a heat body, in this instance formed by a wire mesh arrangement, which, upon being heated, interacts with air causing the air to pass through the device and produce a whistling sound.

While it has been known in the art, therefore, to take advantage of various natural energy sources, such as the wind or sunlight, for various purposes, so far as the present inventor is aware, no means has previously been devised for taking advantage of and audibilizing, or making audible, or more than normally audible, the falling impact of precipitation such as raindrops and the like.

OBJECTS OF THE INVENTION

It is an object of the present invention therefore to provide an apparatus for audibilizing, or making audible, the impact of falling raindrops.

It is a further object of the present invention to improve the audibility of rain by providing a means which upon impact by rain or other precipitation will give off a pleasing tone.

It is a still further object of the present invention to provide a chime type means which upon impact by rain and other precipitation will give off a pleasing tone or sound.

It is a still further object of the present invention to provide a chime means which upon being struck by precipitation such as rain and the like will give off a pleasing and restful series of sounds or tones.

It is a still further object of the present invention to provide an apparatus which may be mounted outside a window of a dwelling or the like and which upon being struck by raindrops or other precipitation, will give off pleasing tones.

It is a still further object of the present invention to provide percussion type apparatus having at least one percussion surface held in a position to be exposed to falling precipitation, and particularly raindrops, and which, upon being struck by such precipitation will give off a pleasing and restful sound in the form of a series of percussive tones.

It is a still further object of the invention to provide a percussion type instrument or device which upon being struck by raindrops or similar precipitation will vibrate in a mode which provides a pleasing tone, both restful and slumber inducing, to those within audible range.

It is a still further object of this invention to provide a method and means for transmitting an audible tone produced by the impact of rain or other precipitation upon exterior chime means from the exterior of a residence or other building into the interior thereof.

BRIEF SUMMARY OF THE INVENTION

The present applicant accomplishes the objects set forth above by providing essentially at least one, and preferably a series of, horizontally extended members, which upon being mounted in a suitable position in the path of falling raindrops will, upon being struck by such raindrops, vibrate or resonate giving off a pleasing tone. Usually, or preferably, the horizontally extended members will be in the form of dished or gong shaped members mounted upon a base in a manner which allows free vibration of the gong or chime member. The chime or gong type members may be made of various materials such as tin, plastic, ceramic, wood, aluminum, magnesium, iron, and particularly steel, fiberglass reinforced plastics and the like. The chime members will be in general quite thin, the thinness determining to a large extent the frequency of the tone which is given off. As a general rule, the thinner the material from which the resonant chime or gong member is made, the higher the tone which will be given off by the resonator upon impact by falling precipitation such as rain and the like and in general the more volume of sound will be produced. Means may also be provided to transmit the vibrations provided by the resonation means, or resonator, upon impact by falling precipitation from the resonator means into the interior of an adjacent building through other than the normal restricted pathways through an open window or the like.

BRIEF DESCRIPTION OF THE DRAWINGS

FIG. 1 is an isometric elevation of a rain chime means in accordance with the present invention.

FIG. 2 is a plan view of the embodiment of the invention shown in FIG. 1.

FIG. 3 is a schematic sectional elevation of a partial profile of one possible form of the chime means shown in FIGS. 1 and 2.

FIG. 4 is a schematic sectional elevation of an alternative profile of the chime means.

FIG. 5 is a plan view of a still further embodiment of the invention incorporating a half round chime or tone means.

FIG. 6 is an elevation of the embodiment of the invention shown in FIG. 5.

DESCRIPTION OF PREFERRED EMBODIMENTS

Figure 7:
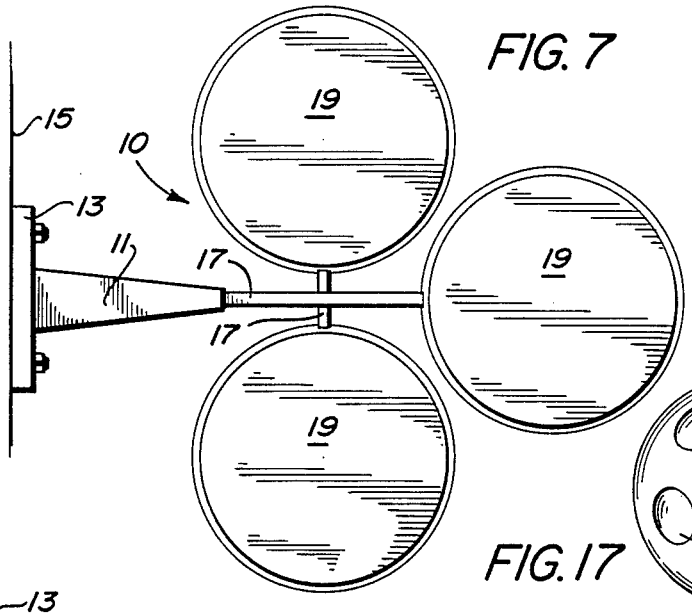
FIG. 7 is a plan view of a further embodiment of the invention incorporating three chime means supported on a bracket in horizontal alignment with each other.

Rain and other precipitation not only is necessary to provide drinking and household water as well as crop irrigation and industrial water but has through past centuries exerted almost a hypnotic effect upon persons exposed to the gentle sound engendered by impact of falling raindrops upon resonating surfaces, such as, for example, roofs positioned outside bedroom windows, thin roofs positioned over eaves beneath which sleeping accommodations may be located and other arrangements. Such impact sounds from rain in particular often have a soporific, or sleep inducing, effect upon those who in the past may have been exposed to them, particularly at bedtime.

The present inventor has discovered that the sound of rain may be amplified and made more audible by providing a transversely positioned resonating means in position to intercept the trajectory of falling rain and other precipitation. Such chime means may preferably be in the form of a thin, rigid material formed in the shape of a shallow dish or plate and mounted upon a bracket adjacent to a bedroom or other window in a position to be impacted upon by falling raindrops. However, other forms of the apparatus of the invention may be provided.

In FIG. 1 there is shown a rain chime means 10 comprising a bracket 11 mounted by screw fittings or wall mountings 13 which mount the ends of the bracket 11 against a building wall 15 in a position where it will be exposed to falling precipitation such as rain. The wall mountings 13 may be secured to the wall 15 by any suitable means such as nail or screw type fastenings, suitable adhesive or other suitable securing means, not shown. Mounted upon the bracket member 11 on transversely extending arms 17 are a series of resonating or resonant chime means 19 each in the configuration of a more or less shallow dish formed from thin substantially rigid material such as plastic, metal, glass, china or other ceramic, wood and the like. The shallow dish configuration is preferably oriented upside down on the bracket 11 and dependent from the end of the floating arms 17 to which it is secured by any suitable means, not shown, which in the case of a metal chime and metal floating arms 17 may be welding, brazing or the like, depending upon the metal composition involved.

The chime means 19 can be made of various metals such as tin, coppper, steel, aluminum, magnesium and the like. As indicated, other chime construction materials may be very satisfactory or even superior. The chime means 19 will be of a thickness which is easily resonated by the impact of a typical raindrop. Such resonation should, of course, be in the sonic range, i.e. be such as will engender sonic or audible atmospheric waves by alternate compression and rarefaction of the surrounding atmospheric gases. The tone which is most pleasing to an individual varies somewhat from individual to individual. However, when using thin plastic such as polyethylene or the like it has been found that a thickness of approximately 0.020 millimeters is very satisfactory. However, such thickness may be varied by up to plus or minus 15% of this dimension or less desirably still up to as much as plus or minus 50% of such dimension. Other materials while having in general comparable desirable thickness dimensions will have their own preferred dimensions which must be such as will result in sonic or audible resonation, a fairly objective criterion, which is pleasing to the listener generally because it sounds like the impact of a raindrop or other precipitation on some frequently encountered natural or artificial surface such as an insulated roof or the like. Such second criterion can, of course, be rather subjective, but usually rather easily recognizable.

Normally, the resonant means will have a more or less constant thickness over its impact surface. However, in some cases it may be desirable to provide the dish shaped chime with a tapered cross section or profile. This is shown more particularly in FIG. 3 which is a partial cross section through one of the chime means 19, shown in FIGS. 1 and 2. The section **19*b* of the chime means 19 can be seen to have a decreasing thickness or otherwise to be tapered with respect to the constant thickness section 19*a* which comprises essentially the central portions of the chime means. In some cases it may be advantageous to have a central portion of the chime means 19 also of decreased thickness as shown more particularly in FIG. 4 where the cross section of the central portion of the chime means 19*c* is illustrated as having a tapering thickness toward the center of the chime means 19. The sections 19*a* of the chime means shown in FIG. 4 in the vicinity of the curvature of the edge of the dish shaped chime is, as shown in FIG. 4**, the thickest section of the chime. Other profile arrangements may also be used. The relative thickness of the sections of the chime means will affect the tone of the chime. In general, however, it will be found to be quite satisfactory to maintain a more or less constant thickness of the chime across its section as this allows the vibration of the chime structure engendered by the impact of raindrops or other precipitation against the chime to be propagated quickly and evenly across the full extent of the chime structure. This usually provides a uniform impact sound which is perhaps most simulative of the usual sound of raindrops as experienced by the average person in his or her early years when interest and fascination with such sound is largely engendered.

FIG. 2 is a top view of the rain chime shown in FIG. 1. It will be noted in FIG. 2 that there are chime means 19 disposed beside each other as well as above each other. Thus, in FIG. 1 it will be understood that only the chime means closest to the viewer can be seen and there are other identical chime means positioned behind the chimes as viewed in FIG. 1. Likewise, in FIG. 2, it will be understood that only the top chime means can be seen and that there are additional chime means, as shown in FIG. 1, positioned under the chime means 19 visible in FIG. 2.

FIG. 5 is a top or plan view of an alternative embodimemt of the chime means of the invention. It will be noted that in FIG. 5 the chime means 19, instead of being round as in FIGS. 1 and 2, is instead only half round. Furthermore, as shown in FIG. 6, which is a side elevation of the rain chime means shown in FIG. 5, there is only one chime means present in the embodiment of FIGS. 5 and 6 and such one chime means has a relatively large transverse dimension. The chime means shown in FIGS. 5 and 6, for example, may have a transverse width from front to back, or, in other words, a radial dimension, of 12 inches and a transverse width from side to side of 24 inches. The chime means 19 may also be supported on the bracket 11 about 20 inches from the wall of the building 15. As shown in FIGS. 5 and 6, the bracket 11 incorporates a telescoping section 21 which may be used to adjust the distance of the chime means 19 from the wall 15 of the building upon which the bracket 11 is mounted. As shown in FIG. 6, the bracket 11 is preferably mounted by the screw fastening plate 13 to the building wall 15 below or adjacent to a window sill 23 at the bottom of the window, which is not shown in the Figures, but which, it will be understood, will normally be open during rain so that the sound of the rain striking the rain chime may be heard by the occupants of the room beyond. It will be understood, of course, that the rain chime may be mounted in various locations adjacent to the window and the exact mounting position will depend somewhat upon the overhang of the roof, not shown, if any, above the section of the building wall 15 upon which the rain chime device is mounted.

FIG. 7 shows a further embodimemt of the invention comprising three large chime means 19 arranged in a more or less triangular disposition, all at one level on a bracket 11. It will be understood, that while the rain chimes shown in FIG. 7 are round or arcuate in shape, such rain chime means could also have other shapes, for example oblong, square or almost any shape desired. The round shape, however, is normally pleasing to the viewer and tends to give forth purer tones when impacted by precipiation of various types since the propagation of the sonic vibrations in the round shape tends to be more even and uniform.

Figure 8:
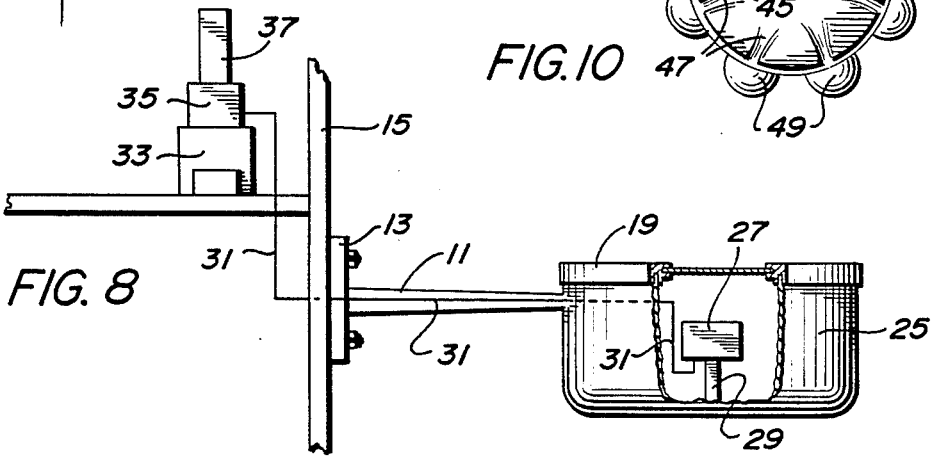
FIG. 8 is a schematic broken away elevation of a further embodiment of the invention including transmission means for conducting the sound of precipitation impacts from the chime means to the interior, of a building.

FIG. 8 shows a further embodiment of the invention in which the chime means 19 is formed from an upper resonant membrane of metal or plastic section supported on the top of a resonating chamber 25 which is supported upon a bracket 11 attached by a fastening plate 13 to the building wall 15. The resonant chamber 25 is shown partially broken away to reveal within the chamber a microphone 27 which is shown upwardly oriented or directed towards the chime means or upper resonant membrane 19. The microphone 27 is supported upon a bracket 29 within the resonating chamber 25 and is attached or connected to a conductive linear lead member or wire 31 which leads from the microphone to and through the wall of the resonating chamber 25 then along the bracket 11 and to an orifice, not specifically shown, in the wall 15 of the building and upwardly to a diagrammatically shown amplifier device 35 which is illustrated supported on a table or stand 33. The amplifier 35 is provided with a diagrammatically shown speaker 37 through which the sound of the raindrops or other precipitation impacting upon the chime device 19 may be broadcast to the interior of the building beyond the wall 15 to which the chime assembly 19 itself is attached. It will be understood that the amplifier 35 will usually be a state-of-the-art apparatus which will render substantially a true reproduction of the sound of the raindrops or precipitation striking the chime or tonality means 19.

Other arrangements for transmitting the sound of the impact of precipitation upon the chime means may also be used. Such means are particularly desirable for those locations or instances where either a window, through which the sound of the impact of the rain upon the chime means can pass may not be open due to other noise or noxious fumes in the external environment, or adverse temperature relationships with relation to the interior of the building, or may be used where no window in fact is available or conveniently available through which the sound of the rain impact may be conducted. While an electronic transmission system is indicated in FIG. 8, it will be understood that other types of transmission systems such as speaker tubes and the like may be used. However, since the sound of rain upon a surface in the form which humans find pleasing and soporific is a fairly pure sound, it will normally be found to be either desirable or in many cases necessary, to provide a fairly sophisticated amplification system such as a modern electronic amplification system in order to provide a pure enough reproduction to be pleasing to the listener.

With the described electronic or other conduction system in operation it will, of course, be possible to mount the rain chime in almost any location where it will be readily accessible to precipitation. Such locations may in some cases be the roof of a building rather than the wall of a building. The provision of the resonating chamber 25 for the physical location of a microphone is advantageous particularly where the environment may be somewhat noisy, one of the prime reasons why the occupants of a building may not sleep with the windows open. The resonating chamber in effect insulates the microphone 27 from external noise except those vibrations engendered by the impact of precipitation against the chime means 19 which may be in the form of a resonant membrane or the like which can be referred to broadly as a tonality member or means. Such chime means 19 usually will be of a composition and thickness which will not readily amplify sounds or vibrations other than direct impact vibrations or sounds. The resonating chamber, of course, also protects the microphone apparatus from the elements, particularly since it is those very elements that the rain chime is designed to record or reproduce. The resonating chamber 25, as the name indicates, is preferably constructed to have the best possible acoustic properties so that the sound of precipitation is accurately and faithfully transmitted to the microphone 27.

While it may be thought that if one is to take the trouble to amplify actual raindrops and transmit them into the interior of a building, it might be more efficient to provide a recording of previously detected raindrops, possibly in a more convenient environment, recorded raindrop impacts do not have the same soothing effect in general upon the listener as the sounds of actual raindrops. In other words, the knowledge that the sound which is heard is of a simultaneously occurring event adds to the enjoyment usually of the sound. For those who may, however, wish to enjoy the sound of rain even when it is not raining, it may be desirable to provide prerecorded rain sounds which may be switched on at the listener's option, whether it is or not actually raining outdoors. Even where this sound is available, it will be found that the listener knowing that it is actually raining externally of the sleeping chamber or other abode will prefer to hear the actual raindrops impacting where this is possible. Consequently, it will be found that the actual raindrop sounds are switched on when it is raining, even where prerecorded raindrop impacts are available for listening to in the absence of actual precipitation.

The principal requirement of the rain chime therefore is that it be constructed from suitable material and of a thickness which upon impact by raindrops in particular and other precipitation as well will vibrate or resonate so as to give forth a pleasing sonic impulse which may be detected by nearby human ears. It will also be understood that it is necessary from a practical viewpoint for the rain chime means to be of sufficient horizontal extent so that it will interrupt the fall of a significant number of raindrops.

Figure 9:
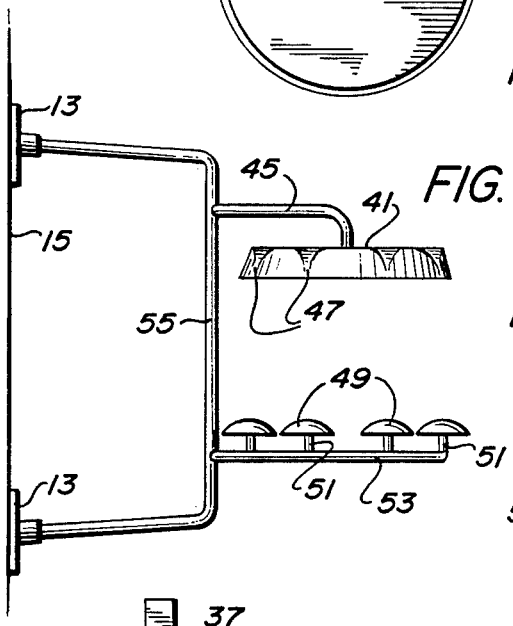
FIG. 9 is an elevation of an alternative embodiment of the invention in which precipitation drops from an upper chime means to lower chime means.
Figure 10:
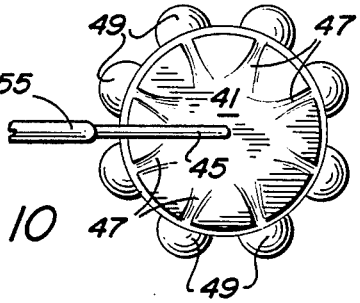
FIG. 10 is a plan view of the embodiment of the invention shown in FIG. 9.

With respect to impact of a significant number of raindrops so as to provide the necessary sound, other embodiments of the invention may be constructed to take advantage or multiply the effect of such impacts. For example, in FIG. 9, there is shown a rain chime device in which there is provided a first relatively large round chime means 41 supported on an arm 45 which is in turn supported by a bracket 55 attached to a building wall 15. The chime means 41, as shown more particularly in FIG. 10, which is a top plan view of the chime device shown in FIG. 9, is contoured on the upper surface so as to have slight indentations or channels leading from the top of the chime means toward the edge of the chime means 41. Each of the contoured indentations is indicated as a contoured channel 47. Directly under the end or termination of each contoured or rain channel 47 is positioned a small chime means 49 supported on upwardly extending arms 51 mounted on a circular bracket extension 53 which is supported in turn from the bracket 55 mounted on the building wall 15. Rain or other precipitation striking the top of the large chime means 41, after vibrating or resonating such chime means, runs toward the outside of the large bell and in so doing tends to be directed by the shallow or contoured channels 47 toward the edge of the large chime means or disk 41 directly over each of the small chime means 49. Such water or moisture then drips from the edge of the large chime directly upon the smaller chime means 49 causing these to resonate and give off a pleasing tone. It is desirable for the large chime means 41 to be at least 12 to 18 inches above the small chime means so that the moisture drops acquire a significant velocity during the course of their fall from the large chime to the small chime and consequently acquire sufficient energy to significantly vibrate the small chime means and give off a pleasing tone. It will be understood that the drop of moisture falling through the air will attain a terminal velocity, i.e. the velocity at which the force of gravity is exactly balanced by the frictional resistance of the air through which the drop is passing, so that the drop after reaching such terminal velocity will not further accelerate due to the effects of gravity. The terminal velocity of any drop is related to the size of the drop, larger drops having a larger terminal velocity than smaller drops and consequently requiring a further fall before they reach such velocity. As may be understood, it is desirable that the drops of water reach their terminal velocity, whatever such velocity may be, prior to impacting upon the small chime means 49 in order to engender the maximum sound or sonic pulse. However, the attainment of terminal velocity is not absolutely necessary nor, in many cases, even attainable within a practical distance.

The shallow channels 47 in the surface of the large chime 41 can be formed by stretching the material of the chime, whether of plastic or metal, under heat. This will also tend to provide a somewhat different tone to the chime in the thinned portion. This same effect may be taken advantage of by deliberately stretching under heat the material of a chime and particularly a metal chime to provide different tones to different portions of the chime, somewhat in the same manner as the construction of marimba drums found in the West Indies, see in particular FIGS. 17 and 18 and the accompanying description pertaining thereto.

Figure 11:
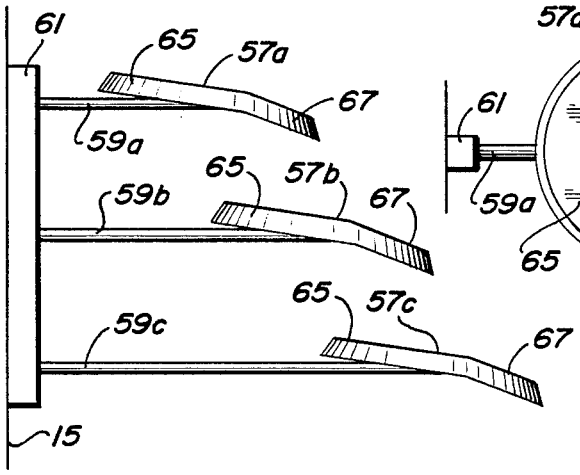
FIG. 11 is an elevation of an alternative embodiment of the invention in which precipitation may drop from one chime means to another.
Figure 12:
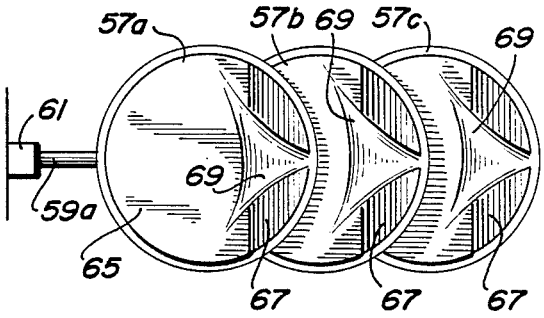
FIG. 12 is a plan view of the embodiment of the invention shown in FIG. 11.

FIG. 11 is a side elevation of a further embodiment of the invention wherein several chime means 57 are positioned over each other in staggered relationship so that moisture from the first chime means **57*a* tends to be discharged onto the surface of the second chime means 57*b* and the moisture from the surface of this chime means 57*b* tends to be discharged onto the surface of the third chime means 57*c*. Each of the chime means 57*a*, 57*b*, and 57*c* are supported or mounted upon bracket arms 59*a*, 59*b* and 59*c*, which are in turn supported by a bracket base 61 secured to the building wall 15** in any suitable manner.

It will be seen in FIG. 11 that each of the chime means 57 are not only mounted at an overall angle on the bracket arms 59, but each chime means **57*a*, 57*b* and 57*c* has an upper section 65 having a basic angle or inclination with respect to the bracket extension arms 59 and a lower section 67 having a somewhat greater angle with respect to the bracket arm 59. In other words, the surface of each chime 57 has two inclinations from horizontal, an upper lesser inclination and a lower greater inclination. The lower greater inclination sections 67 are also provided with shallow contoured channels 69 which lead to the edge of the respective chime means 57 and drop moisture collected on the surfaces of such chime means over the lower edge of the chime where it drips onto the next lower chime means, thus providing a multiplication of moisture drops hitting the chime means. Although the chimes shown in FIG. 11** appear to be relatively close together, it will be understood that the farther apart they are, the more force the moisture drops will have when they hit the next lower chime, at least up to the terminal velocity of the water drops, and the louder the sound which will be engendered.

Figure 13:
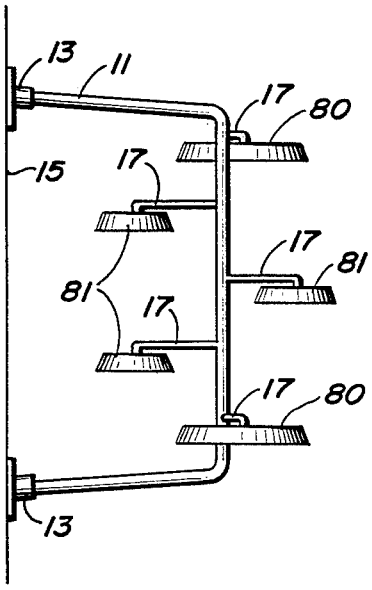
FIG. 13 is an elevation of an alternative embodiment of the invention.
Figure 14:
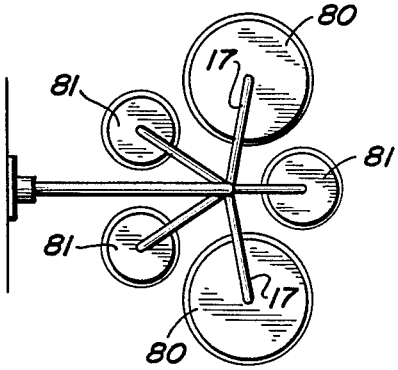
FIG. 14 is a plan view of the embodiment of the invention shown in FIG. 13.

As illustrated more particularly in FIGS. 13 and 14, which show respectively an elevation of a chime device in accordance with the invention and a plan view of the same device, a chime means similar to that shown in FIGS. 1 and 2 may be provided with large chime means 80 and relatively small chime means 81 which as shown may be of various sizes. The different size chimes will provide different tones as they are struck by precipitation and this arrangement will be very pleasing to some individuals. However, it will also be found that since the sound of raindrops is usually fairly constant as it is heard under natural conditions, most individuals will prefer to have chimes of more equal size or composition so that a substantially constant impact sound will be given off by such chimes.

Figure 15:
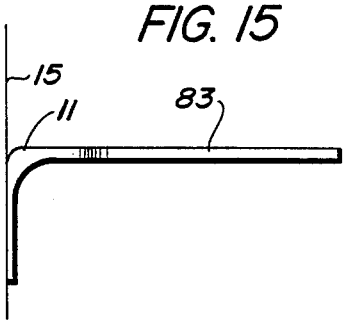
FIGS. 15 and 16 are respectively an elevation and a plan view of a simplified version of a chime means in accordance with the invention.
Figure 16:
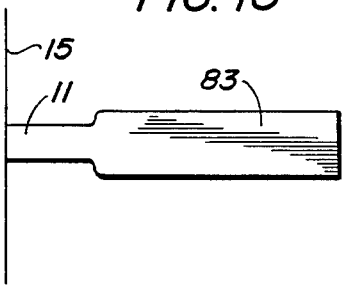

FIGS. 15 and 16 show respectively an elevation and a plan view of a highly simplified chime means in which the bracket 11 attached to the building wall 15 is an integral part of the chime means 83, being merely an extension of the same section of metal or other material from which the chime is constructed. In fact, the chime itself could be attached directly to the building wall and in such event such section would be considered inherently to constitute the bracket or to have a dual function insofar as it may serve as a bracket and a portion of the chime itself at the same time. The essential element of the invention is the provision of a laterally extended chime in the path of falling precipitation.

Figure 17:
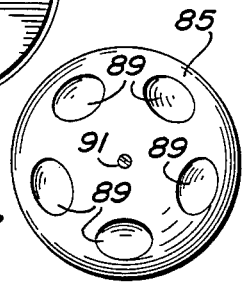
FIG. 17 is a plan view of an embodiment of the invention in which a single chime means is provided with differential sections which give off different tones when impacted by falling precipitation.
Figure 18:
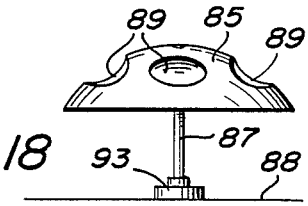
FIG. 18 is an elevation of the embodiment of the invention shown in FIG. 17.

FIGS. 17 and 18 show respectively a plan view and an elevation of an embodiment of the invention including a single large metal chime means 85 which is supported upon a vertical bracket 87 mounted upon a horizontal surface of building structure 88. The large chime 85 has a series of sections 89 incorporated in the main chime which may be essentially thinner than the surrounding sections and therefore resound with a different tone than the main portion of the chime when struck by precipitation. These sections may usually be formed by a working of the metal under the influence of localized heating. Such sections may be of different thicknesses providing different tones or may themselves be all of one thickness providing a substantially uniform tone from one to the other, although different from the tone of the main portion of the chime structure. The bracket 87 may be secured to the center of the chime 85 by a screw threaded fastener means 91 and is supported in a base 93 attached to the building structure 88. It will be evident that the chime means 85 could also be supported from a side bracket as illustrated in the majority of the other figures.

It will be understood that while the invention has been described in considerable detail in connection with the above drawings and explanation of the various embodiments illustrated, the invention is not to be limited to the particulars of any such embodiments, but is meant to be construed broadly with reference to the appended claims so as to provide the broadest possible interpretation of such claims in view of the prior art and thereby to effectively encompass the intended scope of the applicant's invention.

I claim:

1. An apparatus for providing a sound when directly impacted by atmospheric precipitation comprising:

(a) a support means, (b) at least one laterally extended chime means having an upper surface area adapted to be exposed to interrupt the fall of multiple particles of atmospheric precipitation designed and constructed for resonant vibration within an audible range when impacted upon said upper surface by said atmospheric precipitation.

2. An apparatus in accordance with claim 1 wherein the support means is a bracket adapted for mounting on a building construction.

3. An apparatus in accordance with claim 2 wherein the chime means has the general configuration of an inverted dish.

4. Apparatus in accordance with claim 3 wherein the chime means is formed from a thin section of a material selected from the group comprising:

(a) a ferrous metal, (b) ceramic, (c) plastic, (d) a non-ferrous metal.

5. An apparatus in accordance with claim 3 wherein the chime means is formed from plastic and is generally from 0.01 to 0.03 millimeters in thickness.

6. An apparatus in accordance with claim 3 wherein the chime means is formed from plastic and has a generally tapered configuration from the central portion toward the edges.

7. An apparatus in accordance with claim 5 wherein the chime means is from about 0.015 to 0.025 millimeters in thickness.

8. An apparatus in acordance with claim 7 wherein the chime means is from about 0.0175 to 0.0225 millimeters in thickness.

9. An apparatus in accordance with claim 8 wherein the chime means is from about 0.185 to 0.0215 millimeters in thickness.

10. An apparatus in accordance with claim 3 wherein there are a plurality of chime means.

11. An apparatus in accordance with claim 10 wherein the parameters of at least two of the chime means are different in order to provide different tones when impacted by raindrops.

12. An apparatus in accordance with claim 3 wherein some of the chime means are positioned directly under other chime means so that moisture leaving the surface of an upper chime means will impact upon the lower chime means.

13. An apparatus in accordance with claim 12 wherein the surfaces of the upper chime means are provided with shallow contours which direct moisture to a point directly over a lower chime means.

14. An apparatus in accordance with claim 2 additionally including means for conducting the resonant vibration of the chime means into the interior of a building construction.

15. An apparatus in accordance with claim 14 wherein the conducting means takes the form of an electric conducting means.

16. An apparatus in accordance with claim 3 wherein the chime means has a composition, thickness and conformation to provide pleasing sounds when impacted by liquid precipitation.

17. A method of increasing the audibility of natural precipitation comprising positioning a laterally extended chime means arranged and constructed to provide a sonic tone upon being struck by falling precipitation particles with its upper surface in the anticipated path of such precipitation particles and supporting such chime means in such anticipated path by bracket means attached to a building.

18. A method for increasing the audibility of natural precipitation in accordance with claim 17 comprising interrupting the fall of such precipitation upon a resonating surface which transfers the sound of the impact of such precipitation to a transmitter from where it is transmitted over an electronically operated path to an amplifier and a speaker within a building.

19. An apparatus for providing a sound when impacted by atmospheric precipitation comprising:

(a) at least one laterally extended tonality means having an upper impact surface area to interrupt the fall of multiple particles of atmospheric precipitation designed and constructed for disposition substantially transversely with said upper impact surface in the anticipated path of freely falling atmospheric precipitation;

(b) said tonality means being further designed and constructed for resonant vibration within an audible range when impacted upon said upper surface by such freely falling precipitation; and (c) means for supporting said tonality means with said upper impact surface in the anticipated path of such precipitation.

20. An apparatus for providing a pleasing sound in accordance with claim 19 wherein there are a plurality of tonality means.

* * * * *